US006619572B1

(12) United States Patent
Macy et al.

(10) Patent No.: US 6,619,572 B1
(45) Date of Patent: Sep. 16, 2003

(54) MICRONIZING MILLING MACHINE

(75) Inventors: Gregg Macy, Salt Lake City, UT (US); Stan Payton, deceased, late of Tacna, AZ (US), by Carl A. Payton, legal representative

(73) Assignee: Ecobasics, Inc., Salt Lake City, UT (US)

( * ) Notice: Subject to any disclaimer, the term of this patent is extended or adjusted under 35 U.S.C. 154(b) by 69 days.

(21) Appl. No.: 09/835,071

(22) Filed: Apr. 13, 2001

Related U.S. Application Data

(60) Provisional application No. 60/196,840, filed on Apr. 13, 2000.

(51) Int. Cl.[7] ..... B02C 13/26

(52) U.S. Cl. ..... 241/27; 29/428; 241/197; 241/300

(58) Field of Search ..... 241/27, 197, 284, 241/5, 39, 275, 189.1, 300; 73/470; 29/428

(56) References Cited

U.S. PATENT DOCUMENTS

| | | | | |
|---|---|---|---|---|
| 3,860,184 | A | | 1/1975 | Acton |
| 4,170,903 | A | | 10/1979 | Wanke |
| 4,211,371 | A | | 7/1980 | Hotimsky |
| 4,664,320 | A | | 5/1987 | Steffens |
| 5,174,512 | A | | 12/1992 | Orlandi |
| 5,497,950 | A | | 3/1996 | Schrödl |
| 5,676,025 | A | * | 10/1997 | Lulay ..... 451/343 |
| 5,769,339 | A | | 6/1998 | Karra |
| 5,791,571 | A | | 8/1998 | Hijikata |
| 5,820,045 | A | | 10/1998 | Karra |
| 5,863,006 | A | | 1/1999 | Thrasher |
| 5,967,431 | A | | 10/1999 | Stafford et al. |
| 6,039,277 | A | | 3/2000 | Hamm et al. |

OTHER PUBLICATIONS

Brochure for BalaDyne EM–2000, Machining Center Balancer, BalaDyne Corporation, Ann Arbor, Michigan. 4 pages.

* cited by examiner

*Primary Examiner*—Mark Rosenbaum
(74) *Attorney, Agent, or Firm*—Morris O'Bryant Compagni, P.C.

(57) ABSTRACT

A system which comprises a micronizing milling machine used for the grinding of highly abrasive materials, wherein the micronizing milling machine includes a grinding chamber having a hub and a plurality of beater bars disposed around the hub, wherein the hub rotates, thereby causing the beater bars to grind highly abrasive materials that are fed into the grinding chamber by being poured over a central cone disposed over the hub, thereby directing the highly abrasive material away from the hub, wherein the micronizing milling machine is operated at high speeds by using a load balancer to reduce vibration and prevent excessive wear of the moving components, and wherein the micronizing milling machine obtains a high percentage of material at a desired particle size.

20 Claims, 4 Drawing Sheets

MICRONIZING MILLING MACHINE

This application claims benefit of provisional application No. 60/196,840 filed Apr. 13, 2000,

BACKGROUND

1. The Field of the Invention

This invention relates generally to grinding. More specifically, the present invention enables the efficient micronization of a wide variety of highly abrasive materials, with significantly less wear and damage to the micronizing mill, at a lower cost, and with significantly improved results over existing micronizing processes, as well as improved particle size distribution for less abrasive materials.

2. Background of the Invention

The state of the art in mills for grinding or micronizing various materials is generally characterized by milling machines that suffer significant wear when grinding abrasive materials, cannot grind abrasive materials with any degree of practicality, have poor particle size distributions, or are expensive processes that do not justify the means for grinding. Accordingly, such abrasive materials are only ground at great expensive, or not ground at all.

For example, jet mills are able to grind abrasive materials. However, jet mills require expensive and power hungry compressors that accelerate particles of the material to be ground so that the particles are caused to collide against each other in high speed streams. The impact of the particles against each other causes the particles to break down in size, with repeated circulation through the colliding streams eventually resulting in the desired particle size. Unfortunately, one of the great disadvantages of jet mills is that they require a substantial amount of energy to operate, thus making the cost of grinding abrasive materials prohibitive. Another disadvantage of jet mills is the relatively small volume of material that can be micronized.

Other mills that can be used for grinding include more conventional designs such as ball mills as shown in U.S. Pat. No. 5,769,339 issued to Karra, or a grinding mill as shown in U.S. Pat. No. 5,791,571 issued to Hijikata. Disadvantageously, both of these mills poorly handle the grinding of highly abrasive materials. The most obvious effect of grinding highly abrasive materials is that components of the mills wear excessively, to the extent that they must be stopped after only minutes of grinding in order to replace the worn components. Because of the speeds at which these grinding mills operate, and the nature of the components, the time it takes for the mills to come to a halt may be longer than the time the mills was grinding the abrasive materials.

Another disadvantage of the ball mill design is that the particle size distribution is poor. For example, consider a standard ball mill that micronizing to 200 mesh. The ball mill will typically only obtain 50% of the volume at 20 micron minus. The larger particles will either have to be sent through the ball mill again, or used for some other purpose.

Regarding wear of the mills, the grinding balls of the ball mill are worn down excessively by highly abrasive materials, resulting in the need to replace the balls often. Likewise in grinding mills, rotating bars are quickly worn down. As the rotating bars wear down at different rates, the grinding mill quickly becomes unbalanced. An unbalanced mill jeopardized bearings and other components. It is therefore necessary to stop the mill, and then replace all of the rotating bars at the same time. If they are not replaced together, then the older bars will quickly wear down, again resulting in the unbalanced load after a short time.

Accordingly, there is a great need in the grinding and micronizing industry for a milling, grinding or micronizing machine (hereinafter a micronizing milling machine) that can handle abrasive materials cost efficiently. In other words, the micronizing milling machine should be capable of operating for relatively longer periods of time between maintenance stops, it should not consume the quantity of energy of a similarly sized jet mill, and should be capable of micronizing a larger volume of material in the same amount of time. Of course, such a micronizing milling machine should therefore also perform well with less abrasive materials. The benefits should include cost savings because of reduce energy usage and less frequent replacement of components, time savings because the micronizing milling machine should not have to be stopped for maintenance as often.

It would therefore be an advantage over the prior art to provide a micronizing milling machine that could grind highly abrasive materials for longer periods of time before stopping for maintenance, could grind highly abrasive materials more cost efficiently, could grind less abrasive materials more effectively, and would have improved particle size distribution

SUMMARY OF INVENTION

It is an object of the present invention to provide a micronizing milling machine that can grind highly abrasive materials.

It is another object to grind highly abrasive materials using a micronizing milling machine that would require significantly less maintenance than other types of milling machines would require when grinding these materials.

It is another object to provide the micronizing milling machine that can grind highly abrasive materials while using less energy than jet mills.

It is another object to provide the micronizing milling machine that reduces wear to components while rotating at higher speeds than other rotating milling machines.

It is another object to provide components for the micronizing milling machine that wear longer, and do not have to be as precisely balanced when installed.

It is another object to provide the micronizing milling machine such that it can be scaled for construction in different sizes, depending upon the volume of material that needs to be milled.

It is another object to provide the micronizing milling machine such that it is capable of automatic load balancing.

It is another object to provide the micronizing milling machine such that it can support automated feeding of raw materials to a grinding chamber, and provide a means for retrieving the milled materials.

It is another object to provide the micronizing milling machine such that it includes a means for protecting rotating components while the highly abrasive material is fed into the grinding chamber.

It is another object to provide the micronizing milling machine such that it obtains a high percentage of micronized material at the desired particle size.

In a preferred embodiment, the present invention is a system which comprises a micronizing milling machine used for the grinding of highly abrasive materials, wherein the micronizing milling machine includes a grinding chamber having a hub and a plurality of beater bars disposed around the hub, wherein the hub rotates, thereby causing the beater bars to grind highly abrasive materials that are fed into the grinding chamber by being poured over a central cone disposed over the hub, thereby directing the highly abrasive material away from the hub, wherein the micronizing milling machine is operated at high speeds by using a load balancer to reduce vibration and prevent excessive wear of the moving components, and wherein the micronizing milling machine obtains a high percentage of material at a desired particle size.

In a first aspect of the invention, beater bars are provided which are able to withstand significant abrasion before needing repair or replacement.

In a second aspect of the invention, the load on the beater bars is balanced using a load balancing sensor which enables a load balancer coupled to a shaft of the micronizing milling machine to adjust the load and prevent damage to bearings and other components.

In a third aspect of the invention, a first cone is used to deliver abrasive material to the beater bars, and a second cone is disposed over the first cone to prevent abrasive material that is not yet milled from leaving the housing of the micronizing milling machine through an inlet passage.

In a fourth aspect of the invention, the micronizing milling machine can be operated at a substantially faster rate of rotation relative to other rotating mills.

In a fifth aspect of the invention, the beater bars include a hardface that enables the beater bars to operate for longer periods of time without replacement when micronizing organic and other highly abrasive materials.

These and other objects, features, advantages and alternative aspects of the present invention will become apparent to those skilled in the art from a consideration of the following detailed description taken in combination with the accompanying drawings.

DETAILED DESCRIPTION reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The presently preferred embodiment of the invention has several advantages over the prior art that make it the most cost effective system for grinding highly abrasive materials. Nevertheless, it should be remembered that the advantages obtained when micronizing highly abrasive materials will carry over to less abrasive materials as well.

The present invention is ideal for micronizing materials that are too expensive to grind because either because the energy requirements are too high, or the components of the grinding machines wore out too quickly. Furthermore, the particle size distribution is superior that obtained by a ball mill, and the volume is greater than a jet mill. Thus, the present invention overcomes significant limitations of the prior art mills.

The present invention is able to achieve its success because of a combination of factors that come together to provide a micronizing milling machine that safely operates at high rotational speeds, while protecting attrition components that would otherwise wear down quickly. This is accomplished through 1) unique beater bars that can better withstand highly abrasive materials, 2) a load balancing system coupled to a shaft that enables the micronizing milling machine to compensate for imbalances caused by wear of the beater bars, 3) a system of cones that protect a rotating hub, and 4) obtaining a high percentage of material at the desired particle size without having to regrind.

Figure 1:
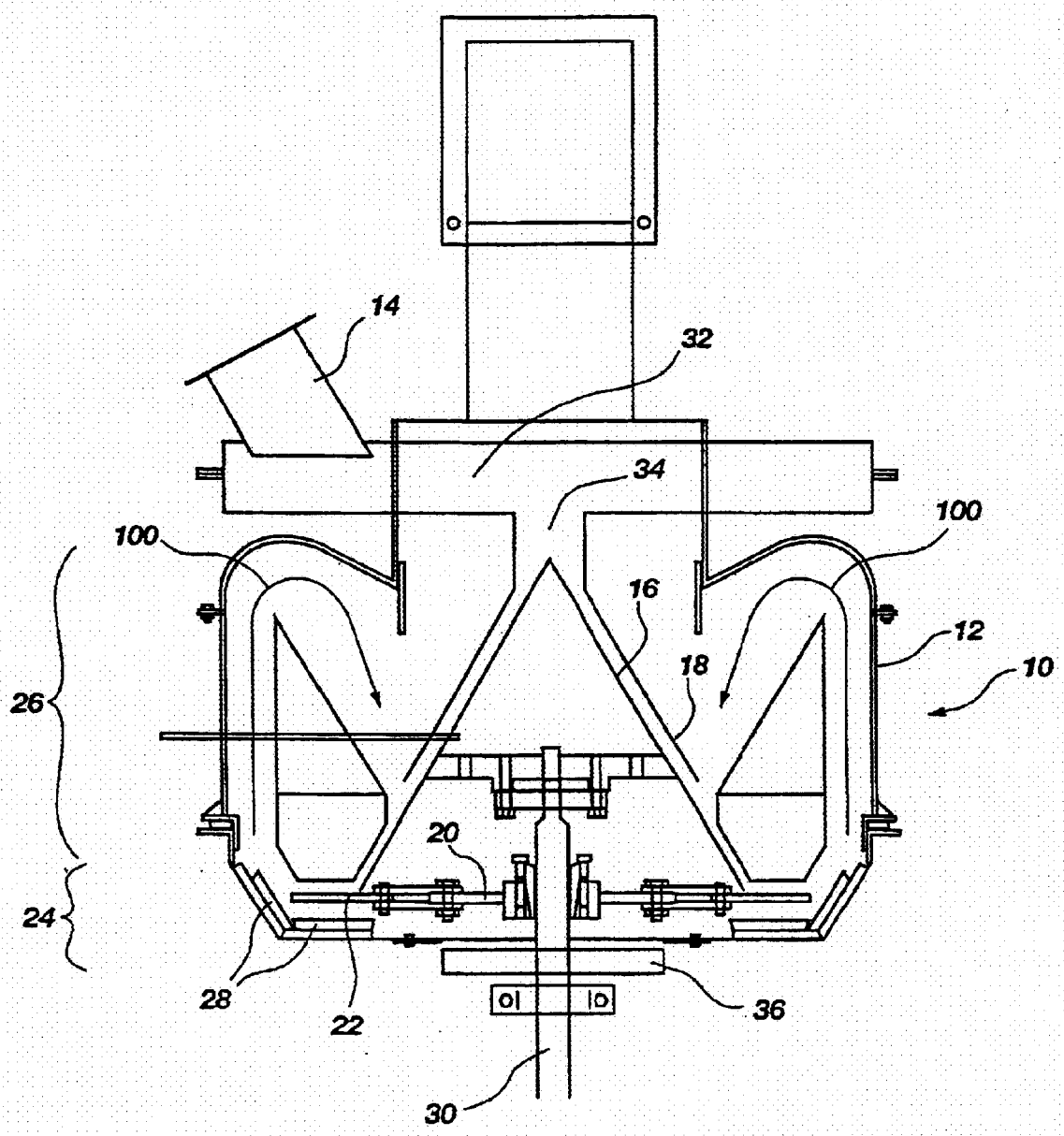
FIG. 1 is a cross-sectional diagram of the presently preferred embodiment, made in accordance with the principles of the present invention.

It is useful to first look at an overall diagram of the presently preferred embodiment before examining each of the novel components. Accordingly, FIG. 1 illustrates the micronizing milling machine in a cross-sectional elevational view. The main elements of the micronizing milling machine 10 of the present invention include a housing 12 (also known as the grinding chamber), an opening 14 into the housing, a first cone 16, a second cone 18, a hub 20, a plurality of beater bars 22 coupled to the hub, and an automatic load balancer 36.

The housing 12 includes a bottom portion 24 and a top portion 26. The top portion 26 is removable to enable servicing of the interior of the housing 12. The housing 12 also includes hardened plates 28 which protect the interior of the bottom portion 24 from the highly abrasive material being micronized.

The hub 20 rotates upon a shaft 30 which is coupled to a motor that is not shown but is disposed beneath the housing 12 of the micronizing milling machine 10. Load balancing is performed by using a machine center balancer (load balancer) 36 that is coupled to the shaft 30 of the micronizing milling machine 10.

Material to be micronized is introduced to the micronizing milling machine 10 through any convenient means. For example, FIG. 1 shows an input port 14. In the presently preferred embodiment, the material moves through a shaft 32 until reaching an opening 34 that is generally disposed over the center of the micronizing milling machine 10.

The material falls down onto the first cone 16. The first cone is disposed over the hub 20 which is generally centered in the middle of the micronizing milling machine 10. The first cone 16 is supported by any convenient means over the hub 20. Thus it can be coupled at various locations to the second cone 18, to the bottom or top portions 24, 26 of the micronizing milling machine 10, or to the shaft 30. What is most important is that the first cone prevents the material from falling directly onto the hub 20. The highly abrasive material that is being micronized could damage the hub 20, and cause a large imbalance to occur. Therefore, it is important that the first cone be at least as large in diameter of the hub 20 so that the material falls onto or even beyond the beater bars 22.

Interestingly, the material being milled is generally not micronized by making contact with the beater bars 22 or with the hardened plates 28. While there is contact, this contact is more incidental to the actual milling process. Most of the milling process occurs as the beater bars 22 cause the material to be accelerated and flung around and around the inside of the housing 12. The material is milled by particle upon particle bombardment. The beater bars 28 thus mainly serve as the means of accelerating particles of the material inside the housing 12 to a speed that is sufficient such that when the particles strike each other, they are broken down to the desired particle size. It is interesting to note that the present invention achieves approximately a 90% particle distribution at the desired particle size in approximately four seconds after the material is fed into the grinding chamber 12.

The shaft 30 rotates the hub 20 which in turn enables the beater bars 22 to accelerate the material that is falling onto them as it falls from the first cone 16. Through experimentation, it was learned that the beater bars 22 had to be of a specific shape and have a hardfacing construction in order to endure the milling process for an extended period of time.

Before creation of the beater bars 22 of the present invention, the inventors experimented with solid bars and chains which are common in the milling industry. However, the solid bars and chains were quickly worn down by the highly abrasive materials. Accordingly, the beater bars 22 are a novel element of the invention because they are able to withstand the harsh conditions of the grinding chamber 12 much better than state of the art beater bars.

Through experimentation, it has been determined that it is the weight of the beater bars 22 that is most important, as well as the overall shape, but not the exact dimensions. Thus, construction of the beater bars 22 is relatively simple, and does not require painstaking precision as will be explained.

Figures 2A, 2B:
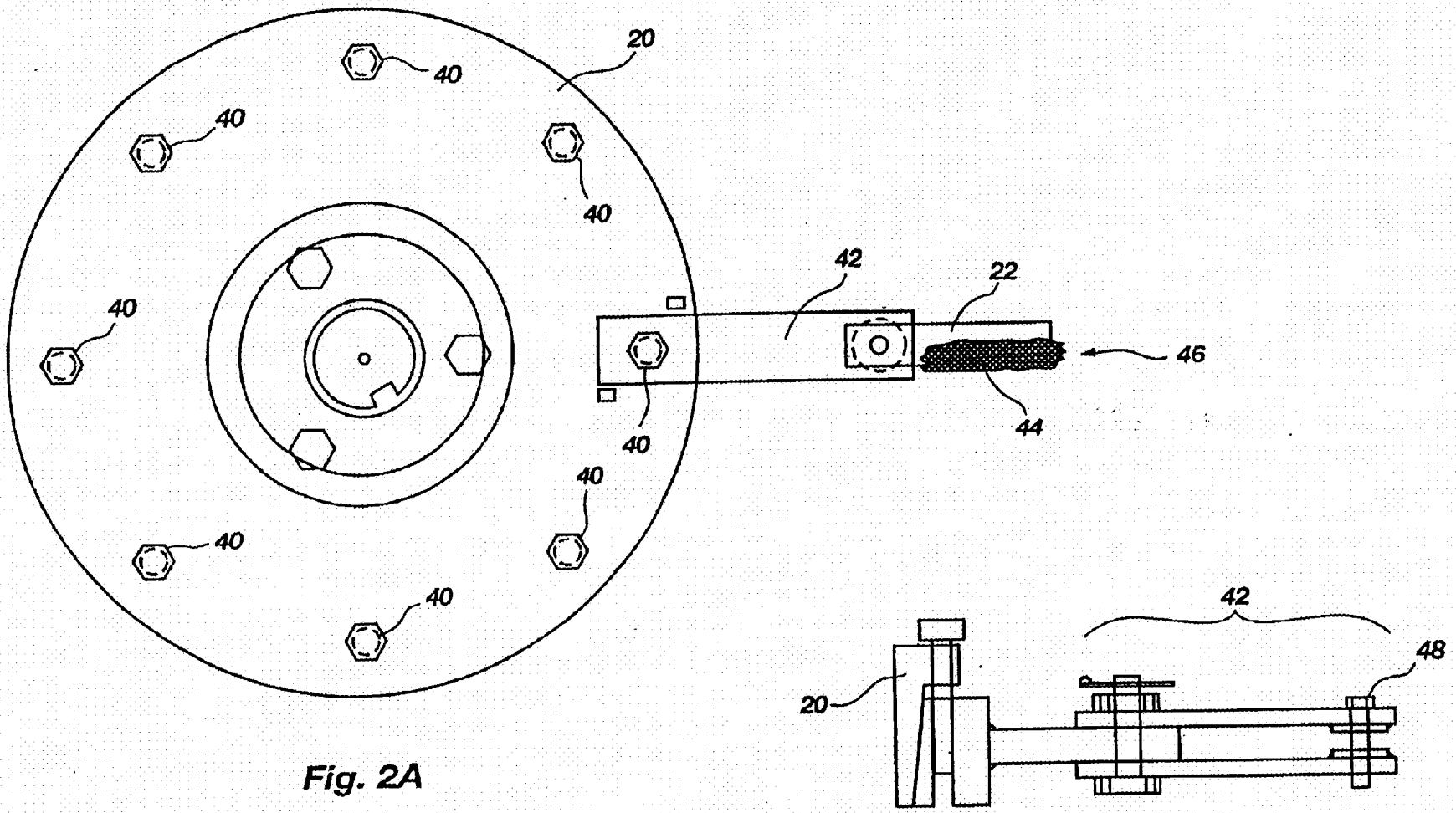
FIG. 2A is a top elevational view of a hub having a single beater coupled thereto via an extension bar assembly.
FIG. 2B is a profile elevational view of the extension bar assembly of FIG. 2A.

The beater bars 22 are coupled to the hub 20 as shown in FIG. 2A. FIG. 2 is a top elevational view of the hub 20. In the presently preferred embodiment, eight beater bars 22 are coupled to the hub 20 at locations 40. The beater bars 22 are actually coupled to the hub 20 using an intermediary extension bar 42. The beater bar 22 is shown as having a hardfacing material 44 on a leading edge 46 thereof. The hardfacing material 44 is welded onto the leading edge 46 of each of the beater bars 22. It is the presence of the hardfacing material 44 on the leading edge 46 of the beater bars 22 that enables the beater bars 22 to withstand the highly abrasive material being fed into the grinding chamber 12 of the micronizing milling machine 10.

The outline of the hardfacing material 44 is not uniform as shown in FIG. 2A. Indeed, the hardfacing material 44 does not have to be applied with any great precision. The most important goal is to achieve the desired weight.

FIG. 2B is provided to show that the extension bar 42 is an extension bar assembly that is coupled to the beater bar 22 at pin 48.

It is noted that it is not enough to simply weld a hard material to the beater bars 22. It was through experimentation that the inventors learned the technique for achieving a hardfacing that can withstand the punishment of highly abrasive materials.

As the beater bars 22 rotate within the grinding chamber 12, the hardfacing material 44 is slowly ground away. Attrition of the hardfacing material 44 is the main reason why the micronizing milling machine 10 gets out of balance as long as the highly abrasive material is kept off the hub 20. Eventually, beater bars 22 must be replaced when the hardfacing material 44 has been worn away an amount where the performance of the micronizing milling machine 10 becomes substantially degraded or too far out of balance. Fortunately, more hardfacing material 44 can be welded back onto the beater bar 22 so that it can be returned to service at a later time.

The presence of the hardfacing material 44 on the leading edge 46 of the beater bars is considered a novel element of the invention. The process for welding the hardfacing material 44 onto the beater bars 22 is described hereinafter. The process will be understood by those skilled in the art from the following description. First, it is necessary to prepare a MIG welder with hard wire. For example, 969-G, 0.045 diameter hard wire can be used. It is also necessary to change the wire feed rolls to the welder. It is preferred to use 3/64" "U" rolls. If they are not used, it can result in wire feeding problems to the welder. The welder is then set to desired parameters as is understood by those skilled in the art.

Second, a carbide dispensing nozzle is attached on top of and slightly ahead of a welding torch nozzle using a clamp. A ground cable should be attached to a welding table, and must make direct contact with the eye of a sensor for controlling carbide feed rate to the welder when the feeder is operating in an automatic mode.

A beater bar 22 should be disposed in a hub simulator to begin welding. This is necessary in order to make the weld as close to the edge of the actual hub 20 as possible using a ½" to ⅝" weaving pattern. The weld is pulled all the way to the end of the beater bar 22. The beater bar 22 is then removed from the hub simulator. Typically no more than two passes with the welder can be made. It is observed that slight changes in the angle of the torch can greatly affect the quality of the weld, and the carbide to weld ratio. A welding angle of approximately 30 to 40 degrees works best. Each beater bar 22 is then weighed and categorized according to weight. In this way, only beater bars 22 of the same approximate weight are used together on a hub 20. It is noted that in the presently preferred embodiment, the final weight of the beater bars is approximately 2.85 pounds. This weight is a function of the size of the micronizing milling machine 10, and is changed to an appropriate amount on smaller or larger machines. It is more important that the weight of each of the beater bars 22 be as close as possible to all others mounted in a micronizing milling machine 10. Thus, the final dimensions are not as important as the weight, and then the shape.

The materials used for welding include the MIG welder, a 98% argon/2% oxygen mix, sintered tungsten carbide 20/30 mesh, hard wire 969-G at approximately 0.045" diameter, and ½"×1¼"×6" plow steel with 17/32" hole drilled ⅝" on center at one end of the beater bar 22.

A comment about the highly abrasive material being micronizing is also relevant to understanding the nature of the invention. Generally organic materials are not micronized because of the difficulty or the cost. The organic materials that the present invention is able to micronize include compost, fish meal, and feather meal. Generally, fibrous organic materials are just not micronized unless the cost of using a jet mill is justified. The present invention is able to micronize these tremendous difficult materials, and at volumes that are much greater than a jet mill, and at highly desirable particle size distributions.

Another novel element of the invention appears to be the combination of first and second cones 16, 18 within the grinding chamber 12. It is observed that the first cone 16 is preferably attached by offset angle plates to the interior of the housing 12. The first cone 16 will preferably remain stationary relative to the upper portion 26 when the upper portion 26 is hydraulically opened. More specifically, the first cone 16 is preferably coupled to an insert which is welded to the housing 12.

The function of the second cone 18 is to prevent the abrasive material from going back up into the opening 34 that the material being micronized is using for entry into the grinding chamber 12. This is accomplished as indicated by arrow 100 which describes the path of the material when it flows up the sides of the grinding chamber 12. This flow path 100 is shown in cross-section, so it occurs all around the sides of the grinding chamber 12.

The micronizing milling machine 10 of the presently preferred embodiment is capable of milling highly abrasive materials that tears attrition (wearable) components of other mills apart. One of the reasons is that highly abrasive materials can rapidly wear down anything that is used to strike them. Thus, the beater bars 22 that are used in the present invention provide a great advantage because they can strike very abrasive material and yet not wear down as quickly as the beater bars used in other mills because of the hardfacing material 44 that is applied to the leading edge 46. Nevertheless, even if other mills were to use the beater bars 22 of the present invention, the beater bars would have to be replaced more often than in the present invention. This is because as the beater bars 22 are worn down by attrition, the wearing is inevitably uneven. Thus, there is always one beater bar 22 that will be worn down more than all the others.

This wearing down of the beater bars 22 will cause a load imbalance. The effects of a load imbalance on a hub is a tendency to cause a shaft to wobble. A wobbling shaft puts a strain on ball bearings, and causes a mill to vibrate. Vibration will damage a mill and cause attrition components to wear out faster. Thus, the mill would have to be stopped, and most likely require the replacement of all the beater bars at the same time in order to restore balance.

In contrast, the present invention is able to overcome this vibration problem through a novel technique that is unknown in the prior art of milling machines. Specifically, the present invention reduces or compensates for load imbalance by providing a load balancer 36. This concept of providing a load balancer 36 has at least two important advantages over the prior art.

First, the load balancer 36 compensates for uneven attrition of the beater bars 22. By compensating for uneven wear, the micronizing milling machine 10 can continue to micronize the highly abrasive material for much longer periods of time without having to stop and perform maintenance. Thus, the actual time available for micronizing is increased because downtime of the micronizing milling machine 10 is reduced.

Furthermore, it is observed that the load balancing is not just a single event. The load balancing is constantly being adjusted on-the-fly. This aspect of load balancing is important because attrition of the beater bars 22 occurs at different rates. Thus, load balancing will continue to adjust for this uneven wearing, thereby reducing wear on attrition parts.

Second, the load balancer also has the affect of enabling the micronizing milling machine 10 to operate at higher rotational speeds as compared to other rotating mills. This is also possible because vibration is substantially reduced by the load balancer 36. Because the micronizing milling machine 10 is able to compensate for load imbalances, the vibration that normally plagues the moving components and causes them to wear out is eliminated until the load balancer 36 can no longer compensate.

Increasing the time that the micronizing milling machine 10 is available for micronizing is not an insignificant accomplishment. This is because the high speed of rotation of the motor is such that it can often take ten minutes or more for the micronizing milling machine 10 to stop spinning once the motor is disengaged. Then the grinding chamber 12 must be accessed, the necessary maintenance performed, the grinding chamber closed, and the mill brought back up to speed again. The time it takes for the mill to stop rotating is due to the extreme rate of speed of the motor and the momentum of the shaft, hub, and the attached beater bars 22. It is noted that in the presently preferred embodiment, the hub 20 can weigh as much as 500 pounds. The hub can weigh much more or less, depending upon the size of the micronizing milling machine 10. Nevertheless, it can be easily recognized that being able to avoid stopping of the micronizing milling machine 10 to perform maintenance can be a substantial time savings, and ultimately a cost savings.

Another advantage of the load balancer 36 is that it makes it possible to have a much wider tolerance in the weight of the beater bars 22. Unlike the beater bars of other mills that require a high degree of precision in weight, shape and dimension because there is no way to compensate for load imbalances, the present invention is able to easily compensate for common variations in beater bar weight. Thus the manufacturing process of the beater bars 22 is relatively fast, as is repair.

Now that the advantages of a load balancer have been introduced, it is worth remembering that it is possible to use the load balancer of the present invention on any type of drive motor. For example, the load balancer can operate with a direct drive motor, or an offset motor that is more common in the grinding industry.

It is also important to understand that the problem of milling highly abrasive materials has plagued the milling industry for many years. Load balancing is presently unknown in the rotating mill industry. The inventors looked to high speed industrial fans to determine how they were able to achieve such high rotational speeds. It was discovered that large, industrial fans often use load balancers to achieve their high rates of rotation. However, it has been necessary to overcome a mindset within the rotating milling industry that a load balancer could even be used. Indeed, those skilled in the art are skeptical at the published results of the present invention, until they actually see the micronizing milling machine in operation.

One load balancer that can be used with the micronizing milling machine 10 of the present invention is the EM-2000 Machining Center Balancer from BALADYNE™. It is interesting to note that the inventors are responsible for making the load balancer industry aware of the applications of their devices in the milling industry. The load balancing industry has since begun to market their products to manufacturers of milling machines.

The load balancer 36 utilized by the present invention is able to continuously monitor vibrations along the shaft to which it is coupled. If vibration becomes excessive, it is capable of shutting down the motor to prevent damage to the attrition parts of the micronizing milling machine 10. Thus, not only will the beater bars 22 receive extended lives, but all moving parts that receive wear during normal operation.

The specific type of load balancer that is required to achieve load balancing is not considered to be a limitation of the present invention. Thus, any load balancer that will compensate for vibrations in the shaft of the micronizing milling machine 10 is a novel aspect of the invention and can be utilized. However, it is noted that the EM-2000 from BALADYNE™ is an effective model because it is capable of non-contacting power transfer.

In operation, the load balancer 36 of the presently preferred embodiment utilizes a counterweight rotor assembly that is mounted permanently to the shaft. A coil assembly mounts to the shaft housing. When a balance correction is required, power pulses are sent to coils that electromagnetically step the rotors to the desired position in a fraction of a second. Because the coils induce an magnetic field across an air gap between the counterweight rotor assembly and the coil assembly, the need for contact between rotating and stationary parts is eliminated. Thus, the load balancer is not a component that requires maintenance because mechanical contact with other components.

The implementation of load balancing of the present invention has had a very obvious affect on operation of the micronizing milling machine 10. The speed of rotation of the micronizing milling machine 10 has increased to 8,000 rpm, a rotational speed that is unprecedented in this milling industry. State of the art mills would tear themselves apart at such speeds once they became imbalanced.

The micronizing milling machine 10 of the present invention is also more energy efficient per ton of production than any other mill. This is especially true when obtaining a particle size of "20 micron minus" is desired. In contrast, the only mill that is capable of obtaining that size today with highly abrasive materials is the jet mill. But the jet mill requires high energy compressors to create the speed necessary to obtain the same size particles through particle bombardment. The energy cost per ton of material can easily be 20 times higher in the jet mill than in the micronizing milling machine 10 of the present invention. Furthermore, the volume of the jet mill is much smaller than the present invention, thus requiring much more time to obtain the desired material.

Figure 3:
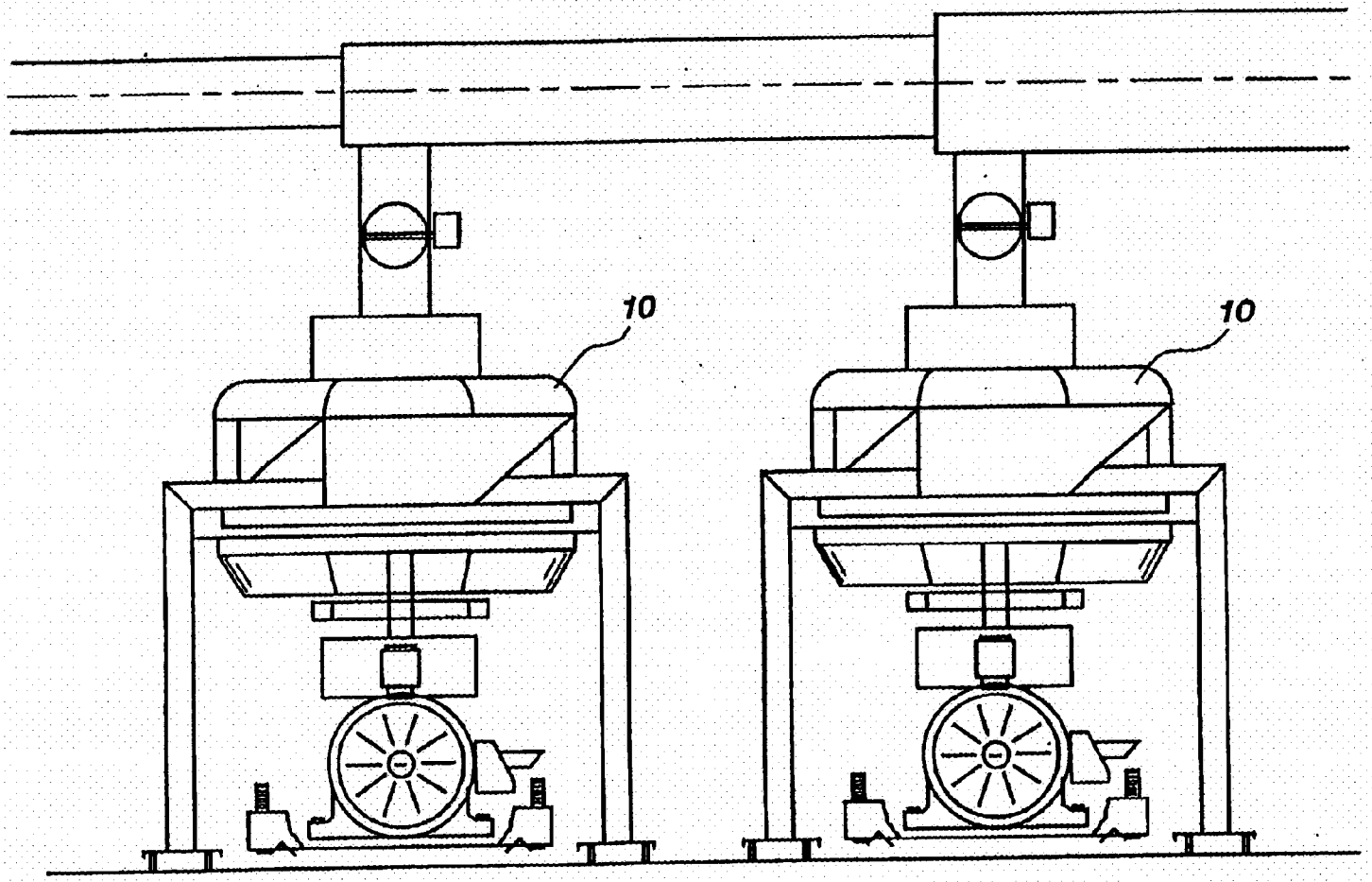
FIG. 3 is a profile elevational view of two micronizing milling machines made in accordance with the principles of the preferred embodiment.

FIG. 3 is a side elevational illustration of how two micronizing milling machines 10 might appear side by side, with approximate relative dimensions.

Figure 4:
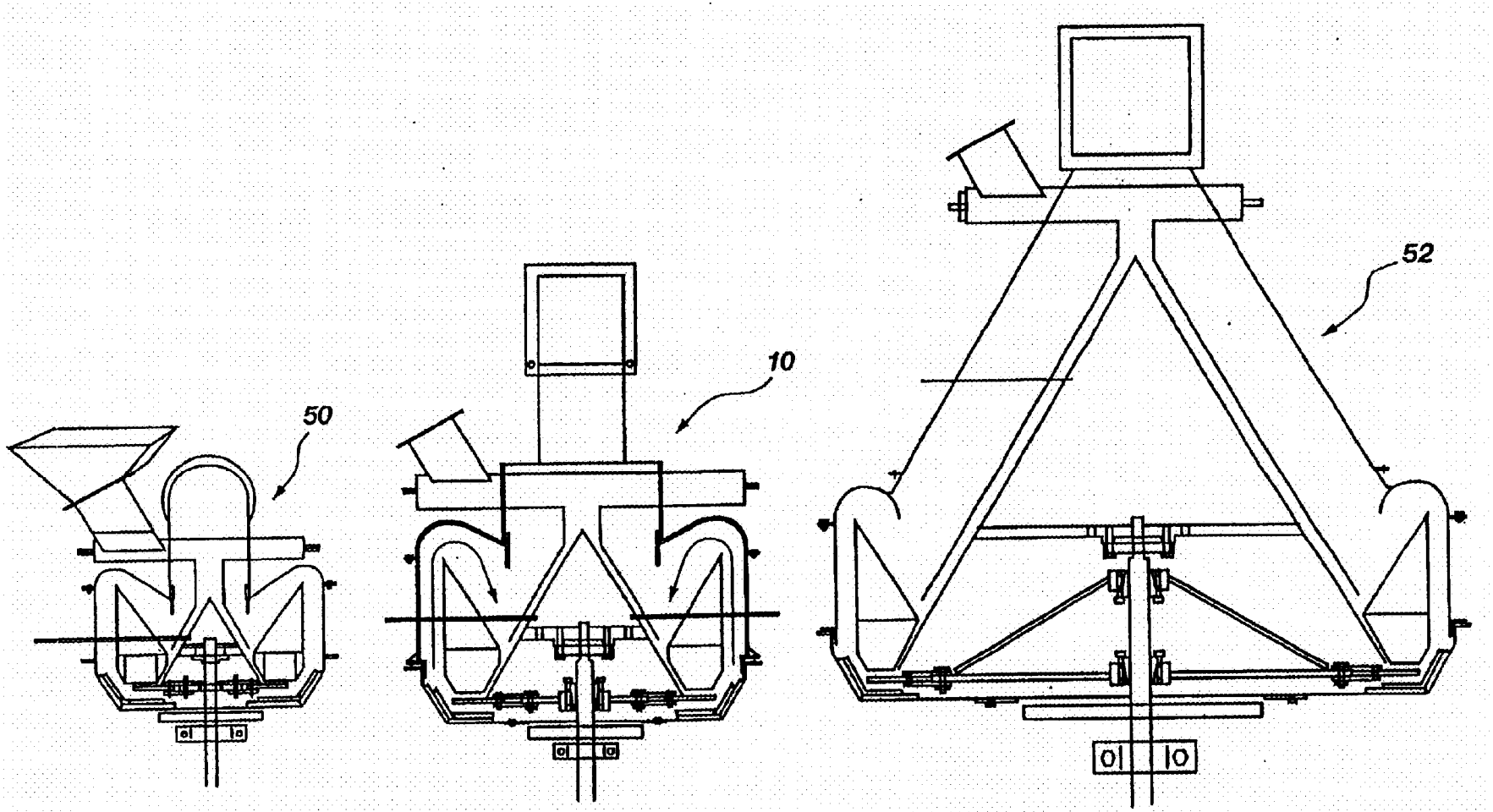
FIG. 4 is a profile elevational view of three micronizing milling machines, scaled to different volumes as desired.

FIG. 4 is provided to show the relative size of three micronizing milling machines 10, 50, and 52. The presently preferred embodiment is the micronizing milling machines labeled as 10. It is capable of an output of approximately 5 tons of organic micronized material per is hour. The smaller micronizing milling machine 50 is scaled down, and capable of an output of approximately 500 to 1000 pounds per hour. The larger micronizing milling machine 52 is scaled upwards, and is capable of an output of approximately 12.5 tons per hour. Thus, the present invention is capable of being scaled up or down, depending upon the volume of material that is desired to be micronized.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A system for milling abrasive materials, wherein the system is capable of load balancing to prevent vibration, said system comprising:

a housing having an upper portion and a lower portion, wherein the upper portion can be moved to provide access to the lower portion;

an entry port in the upper portion for feeding abrasive material into the housing;

a hub disposed in the bottom portion of the housing, a shaft coupled to the hub and extending outside the housing;

a motor coupled to the shaft so as to cause the hub to rotate on an axis;

a plurality of beater bars coupled to the hub so as to extend outwards therefrom;

a first cone which is disposed inside the housing and extending over the hub, such that the abrasive material introduced into the entry port falls onto the first cone and then onto the plurality of beater bars; and a load balancer coupled to the milling machine for sensing an imbalance therein, and compensating for an imbalance when it is detected to thereby reduce vibration.

2. The system as defined in claim 1 wherein the plurality of beater bars are approximately a same weight, and only generally have a similar shape.

3. The system as defined in claim 2 wherein each of the plurality of beater bars further comprises a hardfacing, wherein the hardfacing is welded to a leading edge of the beater bar.

4. The system as defined in claim 3 wherein the hardfacing generally follows the contours of the leading edge of the beater bar, such that the shape of the hardfacing is not as important as a total weight of the beater bar when completed.

5. The system as defined in claim 4 wherein the plurality of beater bars are further comprised of more than a single layer of hardfacing as a result of hardfacing that can be added or removed at any time in order to achieve the desired weight for each of the plurality of beater bars.

6. The system as defined in claim 1 wherein the system further comprises:

a second cone, wherein the second cone is coupled at a top edge to a bottom edge of the entry port, is disposed slightly above the first cone, and is shorter than the first cone, thereby enabling the abrasive material to slide down between the first cone below and the second above; and wherein the abrasive material in the lower portion of the housing can circulate up a sidewall of the housing, and is guided back to the first cone and then down to the plurality of beater bars.

7. The system as defined in claim 1 wherein the load balancer further comprises:

a cylindrical counterweight rotor assembly coupled to the shaft;

a cylindrical coil assembly disposed about the counterweight rotor assembly so as to form two rings, wherein the coil assembly does not make physical contact with the counterweight rotor assembly; and a control module coupled to the coil assembly via at least one control/sensor signal cable, and at least one power pulse cable, wherein the control module receives sensor signals via the at least one control/sensor signal cable, and generates an electromagnetic field in the coil assembly to thereby adjust a position of the shaft relative to the coil assembly to thereby reduce vibration of the shaft.

8. A system for milling materials, wherein the system is capable of load balancing to prevent vibration, said system comprising:

a grinding chamber;

an entry port into the grinding chamber for feeding abrasive material therein;

a hub disposed in a bottom portion of the grinding chamber, a shaft coupled to the hub and extending outside the grinding chamber;

a motor coupled to the shaft so as to cause the hub to rotate on an axis within the grinding chamber;

a plurality of beater bars coupled to the hub so as to extend outwards therefrom; and a load balancer coupled to the shaft for sensing an imbalance, wherein the load balancer alters rotation of the shaft to thereby reduce vibration when an imbalance is detected in rotation of the shaft.

9. A method for manufacturing a milling system that is capable of milling abrasive materials, wherein the milling system is capable of performing load balancing to prevent damaging vibration to the milling system, and wherein the method comprises the steps of:

1) providing a milling machine which includes a grinding chamber, an entry port for the abrasive materials, a hub which spins within the grinding chamber, a shaft coupled to the hub, and a drive motor external to the grinding chamber, and a plurality of beater bars coupled to the hub;

2) disposing a load balancer on the shaft which can detect an imbalance in rotation thereof; and 3) enabling the load balancer to modify rotation of the shaft to thereby reduce vibration of the shaft without stopping the drive motor.

10. The method as defined in claim 9 wherein the method further comprises the step of:

disposing a hardfacing on a leading edge of each of the plurality of beater bars.

11. The method as defined in claim 10 wherein the method further comprises the steps of:

1) disposing approximately a same quantity of the hardfacing on the leading edge of each of the plurality of beater bars;

2) selecting beater bars of approximately a same weight for use together to thereby assist in maintaining a balanced load on the shaft.

12. The method as defined in claim 11, wherein the method further comprises the step of welding the hardfacing to the leading edge of the plurality of beater bars.

13. The method as defined in claim 12 wherein the method further comprises the step of forming the hardfacing on the leading edge of the bear bar by following the contours thereof, wherein the shape of the hardfacing is not as important as a total weight of the beater bar when completed.

14. The method as defined in claim 13 wherein the method further comprises the steps of:

1) adding hardfacing to the beater bar when the milling process has worn away the hardfacing; and 2) removing hardfacing from the beater bar when trying to match a beater bar that is heavier than other beater bars being disposed together on the hub.

15. The method as defined in claim 9 wherein the method further comprises the step of providing a cone within the grinding chamber to prevent the milling material from moving back into the entry port during the milling process, but which does not interfere with the abrasive material from entering the grinding chamber.

16. The method as defined in claim 9 wherein the method further comprises the steps of:

1) disposing a cylindrical counterweight rotor assembly to the shaft;

2) disposing a cylindrical coil assembly about the counterweight rotor assembly so as to form two rings, wherein the coil assembly does not make physical contact with the counterweight rotor assembly; and 3) providing a control module that is coupled to the coil assembly via at least one control/sensor signal cable, and at least one power pulse cable;

4) providing sensor signals to the control module via the at least one control/sensor signal cable; and 5) generating an electromagnetic field in the coil assembly to thereby adjust a position of the shaft relative to the coil assembly to thereby reduce vibration of the shaft.

17. A method of utilizing a milling system to mill abrasive materials, wherein the milling system is capable of performing load balancing to prevent damaging vibration to the milling system, and wherein the method comprises the steps of:

(1) providing a grinding chamber, an entry port into the grinding chamber for feeding abrasive materials therein, a hub disposed in a bottom portion of the grinding chamber, a shaft coupled to the hub and extending outside the grinding chamber, a motor coupled to the shaft so as to cause the hub to rotate on an axis within the grinding chamber, a plurality of beater bars coupled to the hub, and a load balancer coupled to the shaft for sensing an imbalance, wherein the load balancer alters rotation of the shaft to thereby reduce vibration when an imbalance is detected in rotation of the shaft;

(2) disposing the abrasive materials within the grinding chamber of the milling machine; and (3) obtaining an acceptable percentage of a desired particle size of the abrasive material without having to regrind.

18. The method as defined in claim 17 wherein the method of utilizing the milling system further comprises the step of reducing energy costs of obtaining a desired amount of micronized abrasive material.

19. The method as defined in claim 17 wherein the method of utilizing the milling system further comprises the step of selecting the abrasive materials for grinding in the milling machine from the group of abrasive materials that are difficult to grind comprising organic matter, compost, fish meal, fibrous material and feather meal.

20. The method as defined in claim 17 wherein the method of utilizing the milling system further comprises the step of rotating the hub at a higher rate of rotation while load balancing to thereby micronize the abrasive materials.

* * * * *